United States Patent [19]

Wasley et al.

[11] 4,188,422

[45] Feb. 12, 1980

[54] SHRINK-RESISTANT TEXTILES CONTAINING POLYPROPYLENE PROTEINOUS FIBER BLEND PRODUCED BY IMMERSING TEXTILE IN AN INERT LIQUID AT HIGH TEMPERATURE

[75] Inventors: William L. Wasley, Pacific Grove; Walter W. Ingenthron, Jr., Albany, both of Calif.

[73] Assignee: The United States of America as represented by the Secretary of Agriculture, Washington, D.C.

[21] Appl. No.: 838,289

[22] Filed: Sep. 30, 1977

[51] Int. Cl.[2] ..... B05D 1/18

[52] U.S. Cl. ..... 28/167; 8/DIG. 17; 428/359; 427/430 R; 28/165; 8/128 R; 8/DIG. 9; 264/346

[58] Field of Search ..... 19/236 R; 427/430; 428/359; 8/DIG. 17

[56] References Cited

PUBLICATIONS

Cook Handbook of Polyolefin Fibers, Morrow Ltd., Walford, Herts., England, (1967), pp. 116, 117, 172, 173, 184, 523, 524.

*Primary Examiner*—J.C. Cannon

*Attorney, Agent, or Firm*—M. Howard Silverstein; David G. McConnell; Theodore J. Leitereg

[57] ABSTRACT

Textiles containing blends of a proteinous animal fiber and polypropylene are rendered shrink-resistant by heating the textile to a temperature of about 165°–250° C. for a period of 0.1 to 60 seconds.

3 Claims, No Drawings

SHRINK-RESISTANT TEXTILES CONTAINING POLYPROPYLENE PROTEINOUS FIBER BLEND PRODUCED BY IMMERSING TEXTILE IN AN INERT LIQUID AT HIGH TEMPERATURE

BACKGROUND OF THE INVENTION

1. Field of the Invention

This invention relates to and has among its objects the provision of a novel process for preparing shrink-resistant textiles containing blends of proteinous animal fibers and polypropylene. Further objects of the invention will be evident from the following description wherein parts and percentages are by weight unless otherwise specified.

2. Description of the Prior Art

Wool is often blended with other fibers to improve its properties. As with wool alone it is desirable to impart shrink-resistant properties to the wool-fiber blends.

SUMMARY OF THE INVENTION

The invention described herein provides means for preparing shrink-resistant textiles containing proteinous animal fiber-polypropylene blends. In the process of the invention proteinous animal fiber is blended with about 5–50% polypropylene based on the weight of the blend in order to overcome its natural tendency to felt. The so-produced textile blend is rendered shrink-resistant by raising the temperature of the textile to about 165°–250° C. for a period of about 0.1 to 60 seconds. After cooling, the textile exhibits a high degree of shrink-resistance.

The primary advantage of the invention is its simplicity coupled with its ease of operation. The only step required to impart shrink-resistant properties to the blended textile is to raise the temperature of the textile. A further advantage is that, unlike many known shrink-resisting methods, no modifying agents are incorporated into the textile containing proteinous animal fiber-polypropylene blends in the instant process. In addition, the process of the invention can be carried out with equipment which is simple and inexpensive.

A further item is that textiles are rendered shrink-resistant in a very short period—0.1 to 60 seconds—so that the process is adaptable to continuous treatment of long lengths of textiles. The short time required for the treatment has the added advantage that degradation effects on the proteinous fibers are eliminated.

In the process of the invention the dyeing properties of each of the textile components are not substantially altered. This has the advantage that the products can be dyed following conventional formulations and schedules. Accordingly, the present process can be applied to a conventional textile processing line without interference with the dyeing procedure normally employed in the plant.

A further advantage is that the textiles containing proteinous animal fiber-polypropylene blends retain an excellent hand and are soft and pleasant to touch.

DESCRIPTION OF THE PREFERRED EMBODIMENTS

As mentioned above, the process of the invention involves raising the temperature of the textiles containing blends of a proteinous animal fiber and polypropylene to about 165°–250° C. for a period of 0.1 to 60 seconds. Any method for heating the textile may be employed with the proviso that the heat must be distributed throughout the fibers in oder to gain the maximum benefit from the process of the invention. Preferably, the blended textile is immersed in a bath of hot liquid, e.g., an inert oil such as silicone oil, mineral oil, nujol, and the like. It is important that the liquid be inert so that no degradation of the wool occurs and so that the polypropylene does not dissolve.

Following immersion in the hot liquid the textile is removed therefrom and washed with an inert solvent to remove residual heating liquid. Then, the textile is dried and is ready for use.

Other means of raising the temperature of the textile will be evident to those skilled in the art. For example, one may use heated chambers, hot presses, microwave heating, and the like to carry out the process of the invention. It should be noted that the temperature used and the duration of the heating should never be great enough to cause damage either to the proteinous fibers or to the hand of fabric produced from treated fibers.

The process of the invention is applicable to textiles consisting of a blend of proteinous animal fiber and polypropylene. Typical examples of proteinous animal fibers are wool, mohair, camel hair, alpaca, silk, fur, etc. Furthermore, textiles prepared from proteinous animal fiber-polypropylene blends and other fibers such as cotton, linen, hemp, jute, ramie, sisal, cellulose acetate, cellulose acetate-butyrate, saponified acetate rayons, viscose rayons, cuprammonium rayons, ethyl cellulose, polyurethane polyacrylonitrile, polyesters such as polyethylene terephthalate, and the like, can be shrink-resisted by the process of the invention.

The textile to which the invention is applied may be in the form of felt, woven or knitted fabrics, garments, or garment parts.

It should be pointed out that the textile to be treated should contain at least 50% of a blend of proteinous animal fiber and polypropylene, preferably about 80 to 95%, based on the weight of textile. Furthermore, the proteinous animal fiber-polypropylene blend sould contain at least 5% of polypropylene, based on the weight of the blend.

EXAMPLES

The invention is further demonstrated by the following illustrative examples.

EXAMPLE 1

Four ends of wool top, weighing approximately 250 grains per yard, and four ends of a 6 denier polypropylene card sliver, weighing approximately 50 grains per yard, were passed through a pin drafter to form an intimate fiber blend. The resulting blend was passed through the pin drafter an additional four times to assure uniform blending of the wool and polypropylene. This blended sliver was reduced to a roving of 7 grains per yard, and the roving was converted to a single 20's yarn with eight-one half turns per inch of Z twist and to a two ply 20's yarn with four-one half turns of S twist.

The singles 20 yarn which contained approximately 17% polypropylene and 83% wool was used as the filling yarn in a plain weave fabric in which the warp threads were 2 ply 37's cotton. There were 44 ends per inch in the loom and 45 picks per inch. The fabric was soft, pleasant to touch, and had excellent hand.

A 12×14 in.-sample of fabric prepared as above was immersed in silicone oil at 165° C. for 60 seconds. Then, the fabric was removed from the bath and rinsed several times with 300 ml.-portions of Skellysolve F (a hydrocarbon solvent of boiling point 30° to 60° C.). The so-treated fabric was dried in air.

Test specimens, 5×6 inches in size, were laundered twice in an "Accelerotor" at 1780 RPM for 2 min. in 200 ml. of sodium oleate solution at 40° C. After this laundering operation the samples were remeasured to determine area shrinkage. The results are recorded below; percent shrinkage is an average of the area shrinkage of each sample.

The above experiment was repeated with the following exceptions: In one test the specimens were immersed in silicone oil at 170° C. for 60 sec. In another test the temperature of the oil was 180° C. and immersion time was 30 sec.

| Treatment | | Area Shrinkage | |
|---|---|---|---|
| Temperature (°C.) | Time (sec.) | Wash 1 (%) | Wash 2 (%) |
| 165 | 60 | 1 | 2 |
| 170 | 60 | 0 | 2 |
| 180 | 30 | 0 | 1 |
| Untreated control* | — | 8 | 14 |

*Sample as described above without heat treatment in accordance with invention.

EXAMPLE 2

A fabric sample was prepared as described in Example 1. The filling was two ply 20's yarn with four-one half turns per inch of S twist containing 80% wool and 20% polypropylene.

The procedure for shrink-resisting described in Example 1 was followed. The area of shrinkage was determined according to AATCC test 124-69-IA. The fabric samples (5×6 inches) were washed 5 times for 15 min. in a conventional washing machine at high water level with 60 g. of low-sudsing detergent. The area shrinkage was determined and the results are tabularized below.

| Treatment | | Area Shrinkage | | |
|---|---|---|---|---|
| Temperature (°C.) | Time (sec.) | Wash 1 (%) | Wash 3 (%) | Wash 5 (%) |
| 180 | 60 | 2.0 | 5.4 | 8.8 |
| 180 | 30 | 3.5 | 7.4 | 11.2 |
| 180 | 10 | 5.0 | 13.5 | 23.4 |
| Untreated control* | — | 7.2 | 44.9 | — |

*Sample as described above without heat treatment in accordance with invention.

EXAMPLE 3

The fabric described in Example 2 was heated in a hot head press. The fabric was covered with a cotton cloth so that the metal surface of the head press would not come into contact with the fabric. Thermocouples were placed under the fabric which was heated at 175° C. for 30 and 60 sec.

The area shrinkage was determined as described in Example 2. The results are summarized below.

| Treatment | | Area Shrinkage | | |
|---|---|---|---|---|
| Temperature (°C.) | Time (sec.) | Wash 1 (%) | Wash 3 (%) | Wash 5 (%) |
| 175 | 60 | 5.9 | 11.7 | 18.1 |
| 175 | 30 | 7.1 | 14.4 | 20.4 |
| Untreated control* | — | 9.9 | 47.9 | — |

*Sample as described above without heat treatment in accordance with the invention.

Having thus described our invention, we claim:

1. A process for imparting improved properties to proteinous animal fibers, which comprises:
   (a) blending polypropylene with the proteinous animal fiber such that the blend contains about 5–50% of polypropylene based on the weight of the blend, and
   (b) heating the blend to a temperature of about 165°–250° C. for a period of about 0.1 to 60 seconds by immersing it in an inert liquid.
2. The process of claim 1 wherein the proteinous animal fiber is wool.
3. The process of claim 1 wherein the inert liquid is silicone oil and the temperature is about 165°–250° C.

* * * * *